United States Patent [19]

Klimboff et al.

[11] 3,975,781

[45] Aug. 24, 1976

[54] FIXTURE INSTALLATION ASSEMBLY

[75] Inventors: Morris Klimboff, Cincinnati, Ohio; Wilfred G. Harvey, Sr., East Brunswick, N.J.

[73] Assignee: Powers-FIAT Corporation, Skokie, Ill.

[22] Filed: Aug. 11, 1975

[21] Appl. No.: 603,370

[52] U.S. Cl. ..... 4/170; 4/187 A

[51] Int. Cl.[2] ..... A47K 1/04; E03C 1/32; E03C 1/13

[58] Field of Search ..... 4/187 A, 170, 68, 173, 4/173 S, 185 R; 248/311, 234

[56] References Cited

UNITED STATES PATENTS

| | | | |
|---|---|---|---|
| 1,039,903 | 10/1912 | Crane | 4/173 S |
| 1,600,852 | 9/1926 | Shaffer | 4/170 |
| 2,584,107 | 2/1952 | Beam | 4/170 |
| 3,118,147 | 1/1964 | Larkin | 4/170 |
| 3,364,503 | 1/1968 | Mustee | 4/170 |

FOREIGN PATENTS OR APPLICATIONS

| | | | |
|---|---|---|---|
| 285,541 | 9/1926 | Denmark | 4/170 |
| 445,947 | 4/1936 | United Kingdom | 4/170 |

*Primary Examiner*—Henry K. Artis
*Attorney, Agent, or Firm*—James B. Blanchard; Jerold A. Jacover

[57] ABSTRACT

A fixture installation assembly adapted to be hung from support means secured to a surface member is disclosed. The assembly includes a pair of side panels, adapted to hang substantially vertically from the support means, having an attachment member near the lower end. The assembly also includes a bottom panel having an attachment member near each end thereof. One of the attachment members comprises latching means and the other comprises latch engagement means so that the bottom panel is supportively secured to the side panels for spacing the fixture a predetermined distance from the surface member.

8 Claims, 6 Drawing Figures

FIG. 2
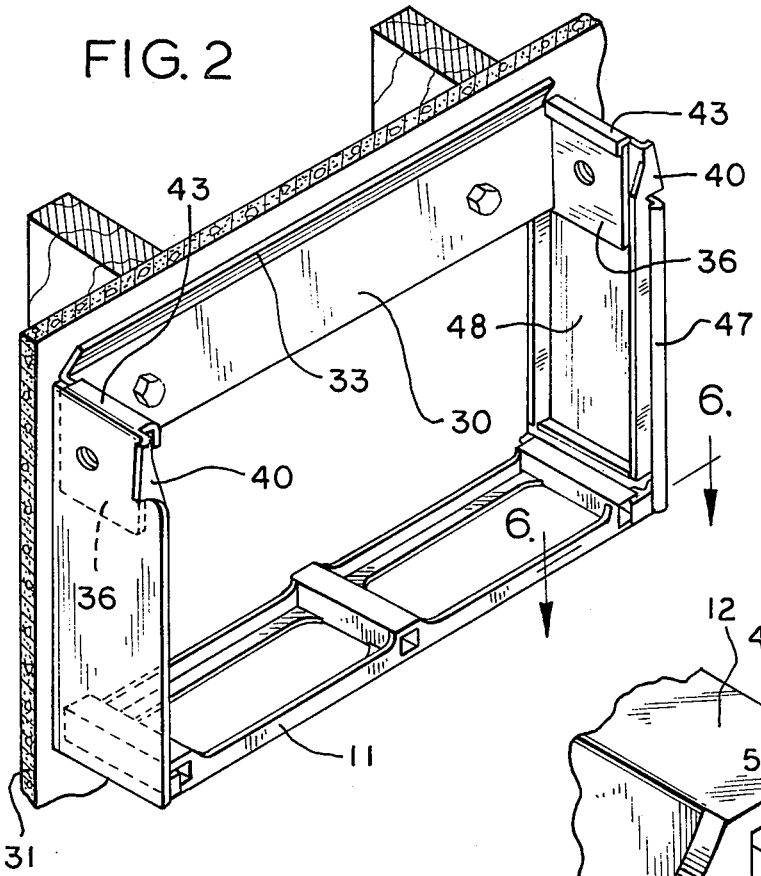
FIG. 4
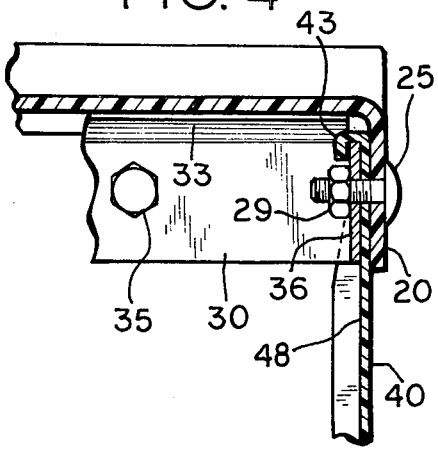
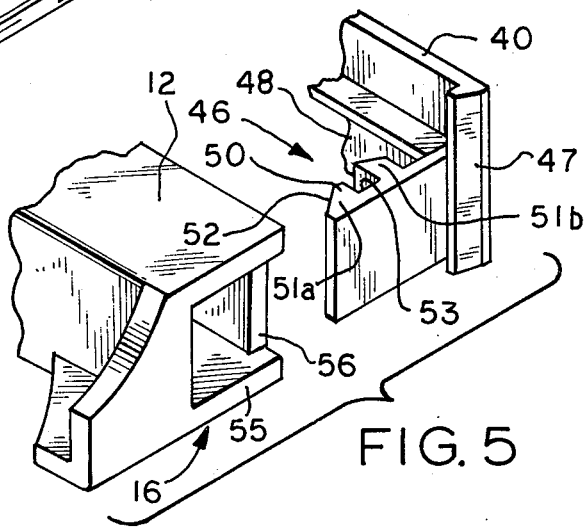
FIG. 5
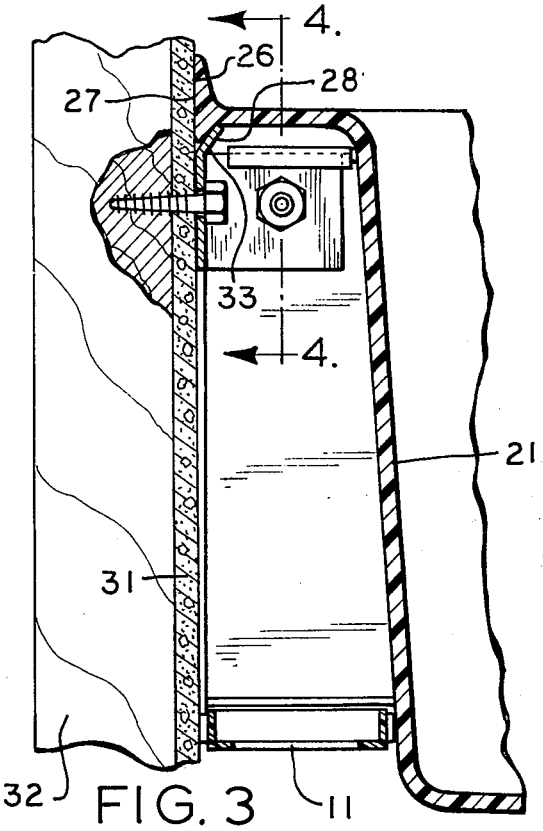
FIG. 3
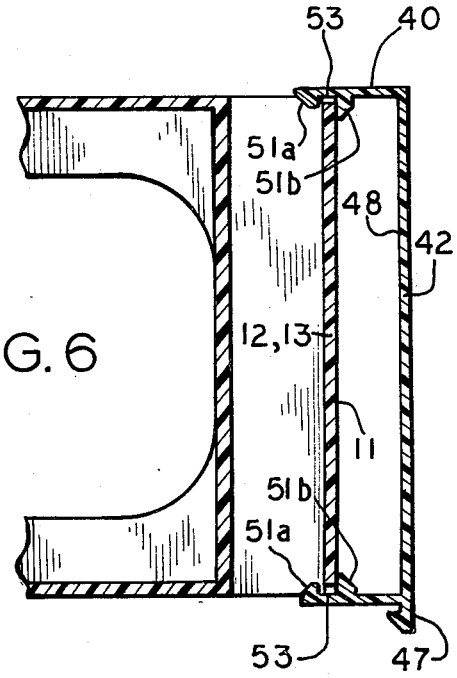
FIG. 6

FIXTURE INSTALLATION ASSEMBLY

BACKGROUND OF THE INVENTION

This invention relates to an installation assembly used for supporting fixtures such as a molded laundry tub. The assembly of the type described also serves to space the laundry tub a predetermined distance from the wall to which it is secured to accommodate service pipes and the like. More particularly, the invention relates to a fixture installation assembly having a pair of side panels adapted to hang substantially vertically from a supportive member attached to the wall, and a bottom panel secured between the lower ends of the side panels to space the fixture a predetermined distance from the wall.

Conventional installation assemblies suffer from numerous drawbacks and deficiencies which tend to limit their desirability and use. For example, some installation assemblies of the prior art require that the supportive bracket, the side panels and the bottom panel be pre-assembled, and then attached as a unit to the wall. This can be both cumbersome and time-consuming. Other assemblies of the prior art provide a supportive bracket to be separately attached to the wall, and an integral side panel-bottom panel combination which is then secured to the supportive member. It can be readily appreciated, however, that this arrangement prevents the side panels and bottom panel from being broken down for shipment, thereby increasing the expense of packaging the assembly, and making the handling thereof more difficult. Still other prior art assemblies use separate side and bottom panels which must be secured together with screws, bolts, and the like during installation. Though this obviates some of the problems in packaging and handling mentioned hereinbefore, it requires a certain amount of time, skill and effort to put the panels together.

It is thus a primary object of the invention to provide an improved fixture installation assembly.

It is another object of the invention to provide an improved fixture installation assembly which can be put together in minimal time with minimal skill and effort.

A further object of the invention is to provide an improved fixture installation assembly in which certain components can be put together without tools, and without the use of screws, bolts and the like.

Still another object of the invention is to provide an improved method for assembling a fixture installation assembly of the type described.

SUMMARY OF THE INVENTION

All of the objects of the invention, along with numerous features and advantages, are achieved in a novel fixture installation assembly adapted to be hung from support means secured to a surface member. The assembly comprises a pair of side panels adapted to hang substantially vertically from the support means, each of the side panels having a side panel attachment member near its lower end. The assembly includes a bottom panel of predetermined dimensions having, near each end thereof, a bottom panel attachment member. One of the attachment members comprises latching means, and the other attachment members comprise latch engagement means, so that the bottom panel is supportively secured to the side panels. The bottom panel further has an outer edge, adapted to intercept the fixture when the fixture is secured in hanging relation from the support means, whereby the bottom member serves to space the fixture a predetermined distance from the surface member.

BRIEF DESCRIPTION OF THE DRAWINGS

The invention summarized above can be better understood by reading the following detailed description in conjunction with the accompanying drawings in which:

FIG. 2 is a perspective view of a portion of the fixture installation assembly shown in FIG. 1;

FIG. 3 is a sectional view of a portion of the fixture installation assembly shown in FIG. 1;

FIG. 4 is a sectional view taken along lines 4—4 in FIG. 3;

FIG. 5 is an enlarged perspective view of a portion of the fixture installation assembly shown in FIG. 1; and FIG. 6 is a sectional view taken along lines 6—6 of FIG. 2.

DETAILED DESCRIPTION OF AN EXEMPLARY EMBODIMENT

Figure 1:
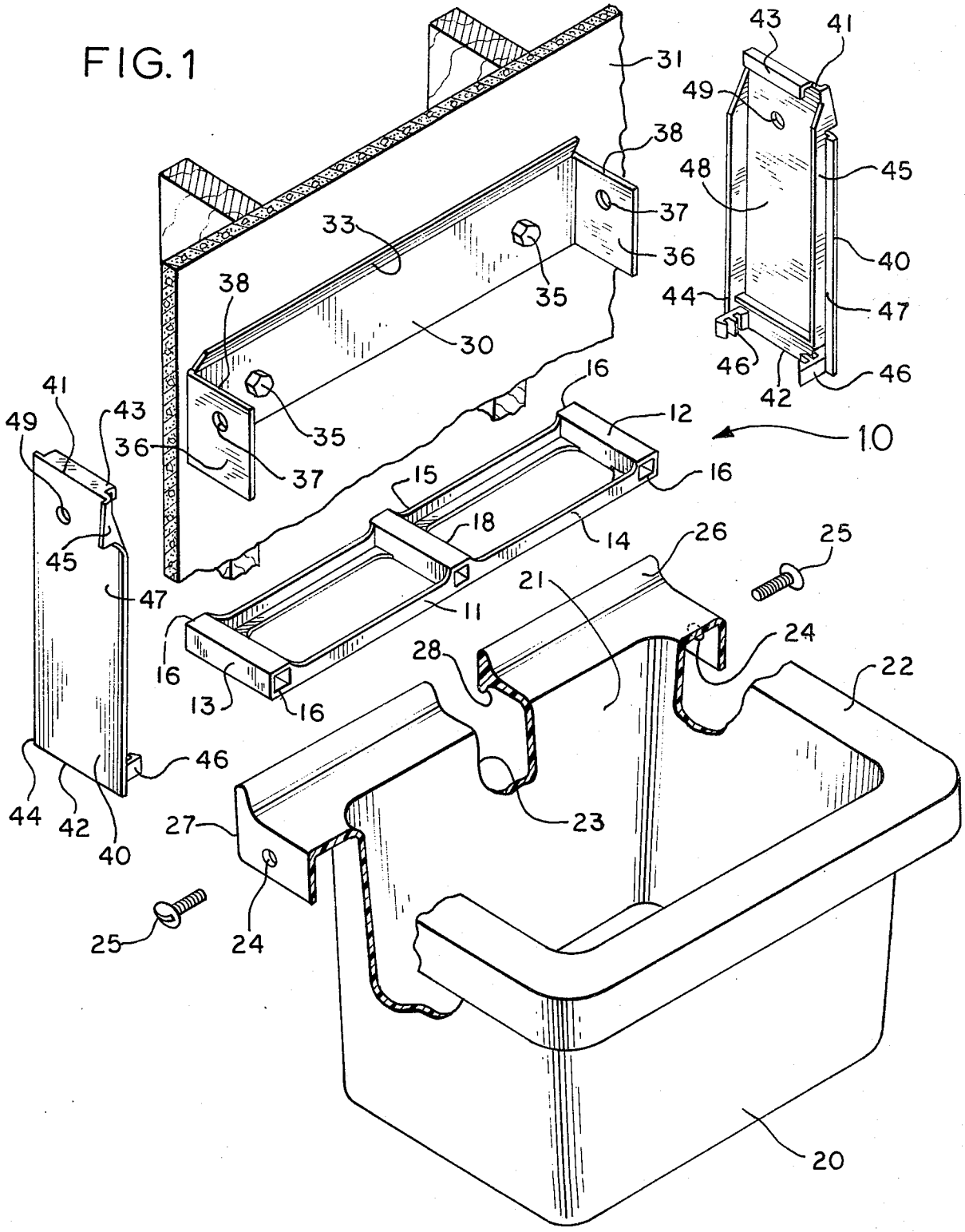
FIG. 1 is an exploded, perspective view of a fixture installation assembly embodying the invention.

Referring now to the drawings, and in particular to FIG. 1, a fixture installation assembly embodying the invention is referred to generally by the reference numeral 10. Assembly 10 includes a bottom panel 11 and a pair of side panels 40, preferably, though not necessarily, fabricated from medium impact polystyrene.

In this exemplary embodiment, bottom panel 11 comprises an open rectangular framework of predetermined dimensions defined by a pair of parallel end members 12, 13, an outer edge member 14 extending between end members 12, 13, and an inner edge member 15 extending between end members 12, 13 a predetermined distance from outer edge member 14. Bottom panel 11 further includes a center structural member 18 extending parallel to end members 12, 13. Disposed at each corner of bottom panel 11, i.e., at each junction of each end members 12, 13 with inner and outer edge members 14, 15, is a bottom panel attachment member 16 whose function is described in greater detail hereinafter.

Side panels 40 are also of generally rectangular shape, each being characterized by an upper edge 41, a lower edge 42, an inner edge 44 and an outer edge 45. A shield portion 47 preferably extends outwardly from outer edge 45. At the two lower corners of each side panel 40, i.e., at each junction of lower edge 42 with inner edge 44 and outer edge 45, there is located a side panel attachment member 46. Each side panel attachment member 46 is adapted to cooperate with a respective bottom panel attachment member 16 to support bottom panel 11 in horizontally hanging relation. Side panels 40 also include, at upper edge 41, an integral right angle member 43 which engages a supportive member 30.

Supportive member 30 is generally rectangular in shape and includes, at each short end, a pair of outwardly extending ears 36. Each ear 36 has an upper edge 38 over which corresponding right angle members 43 of side members 40 are hooked as shown in FIG. 2. When so hooked, side panels 40 hang substantially vertically with the interior surface of each side panel facing each other. Each of these facing surfaces of side panels 40, designated by reference numeral 48, have a hole 49, alignable with a corresponding hole 37 in each of ears 36 of supportive member 30. Supportive member 30 is preferably fabricated of metal, and is adapted to be attached to a surface member, such as a wall 31, by a pair of bolts 35 so that side panels 40 hang vertically from ears 36, and bottom panel 11 hangs horizontally between side panels 40.

In this exemplary embodiment, supportive member 30 further includes an outwardly inclined flange 33 at its upper edge. Flange 33 is adapted to support a fixture such as a laundry tub 20, in a manner described hereinafter. Tub 20 preferably includes a basin 21, and an overhanging perimeter member 22. Perimeter member 22 defines screw holes 24 alignable with holes 37 and 49, and cutouts 23 for accommodating service pipes, faucets, and the like. At the rear portion of perimeter member 22, there is a ridge 26 having a flat rear surface 27 adapted to fit in flush abutment with wall 31 as shown in FIG. 3. Also defined near the lower portion of ridge 26 is an elbow-like recess 28. Flange 33 is adapted to be seated into recess 28 to support tub 20 in hanging relation.

When tub 20 is supported in hanging relation by supportive member 30, the weight of tub 20 produces a moment about flange 33. This creates a tendency for tub 20 to pivot about flange 33 in such a manner that the bottom of basin 21 is urged inwardly toward wall 31. It is primarily for the purpose of preventing the bottom of basin 20 from contacting wall 31, that bottom panel 11 is deployed. In particular, bottom panel 11 is fabricated of sufficient width as to intercept the bottom of basin 21, thereby spacing the basin a predetermined distance from wall 31. Such spacing insures sufficient room behind tub 20 to accommodate service pipes and the like, and further insures that basin 21 will not be installed askew.

After flange 33 has been seated with respect to recess 28 of ridge 26, tub 20 and side panels 40 are more securely fastened to supportive member 30 by passing screws 25 through alignable holes 24, 49 and 37 of tub 20, side panels 40, and supportive member 30, respectively. As shown in FIG. 4, a nut 29 is preferably used to maintain each screw 25 in place. It should be observed that when tub 20 and side panels 40 are so fastened, side panels 40, including shield portions 47, hide ears 36 and rearward portions of tub 20 to provide a more esthetic installation.

As mentioned hereinbefore, side panel attachment members 46 are adapted to cooperate with bottom panel attachment members 16 to support bottom panel 11 in horizontally hanging relation. The details of attachment members 46 and 16 are illustrated in FIGS. 5 and 6. More particularly, each of side panel attachment members 46 are shown to include latching means 50 having a pair of projecting members 51*a* and 51*b*, extending perpendicularly from facing surface 48. Projecting members 51*a* and 51 *b* define therebetween a latching recess 53. Projecting member 51*a* further includes a leading beveled edge 52 inclined upwardly toward recess 53.

Each bottom panel attachment member 16 comprises latch engagement means 55 including a rigid member 56. Rigid member 56 is adapted to slide relative to a respective beveled edge 52 of latching means 50 for movement into a corresponding recess 53. Thus, to engage a side panel attachment member 46 with a corresponding bottom panel attachment member 16, rigid member 56 need only be slid along beveled edge 52 until it slips into recess 53. By making the distance between the projecting members 51*a* in each side panel 40 slightly less than the distance between opposing rigid members 56 along edges 12, 13 of bottom panel 11, projecting members 51*a* must be urged slightly outwardly to accommodate rigid members 56. When the rigid members 56 reach a corresponding recess 53, however, respective projecting members 51*a* spring inwardly, thereby holding bottom panel 11 securely into place.

In view of the foregoing, it should be clear that bottom panel 11 can be secured to side panels 40 in horizontally hanging relation without separate fasteners, and without tools. Moreover, the entire installation can be assembled, and tub 20 can be mounted, with a minimal expenditure of time, effect and skill. In particular, installation requires only the following steps: (a) securing supportive member 30 to wall 31; (b) securing side panels 40, having first attachment means, to respective ends of supportive member 30; (c) providing a bottom panel 11 of predetermined dimensions, having second attachment means near each end thereof, one attachment means including a projecting member having a leading beveled edge terminating in a recess, and the other attachment means comprising latch engagement means having a rigid member; and then (d) causing a rigid member to slide along a respective leading beveled edge and into a corresponding recess so that the bottom panel is supported by the side panels.

Though the exemplary embodiment herein disclosed is preferred, it will be clear to those skilled in the art that numerous refinements and modifications can be made which do not part from the true scope of the invention. All such refinements and modifications are intended to be covered by the appended claims.

We claim:

1. In a fixture installation assembly adapted to be hung from support means secured to a surface member, said support means being further adapted to support said fixture in hanging relation, the invention comprising:

a pair of side panels, adapted to hang substantially vertically from said support means, each of said side panels having, near the lower end thereof, a side panel attachment member;

a bottom panel of predetermined dimensions having, near each end thereof, a bottom panel attachment member; one of said attachment members comprising latching means, and the other of said attachment members comprising latch engagement means, so that said bottom panel is supportively secured to said side panels;

said bottom panel further having an outer edge adapted to intercept said fixture when said fixture is secured in hanging relation from said support means, whereby said bottom member serves to space said fixture a predetermined distance from said surface member.

2. The fixture installation assembly defined in claim 1 wherein said side panel attachment member comprises said latching means, and said bottom panel attachment member comprises said latch engagement means.

3. The fixture installation assembly defined in claim 2 wherein each of said side panels has a facing surface, and wherein said latching means include a pair of substantially parallel projecting members extending perpendicularly from said facing surface.

4. The fixture installation assembly defined in claim 3 wherein each of said projecting members has a leading beveled edge.

5. The fixture installation assembly defined in claim 4 wherein each leading beveled edge of each of said projecting members terminates in means defining a recess.

6. The fixture installation assembly defined in claim 5 wherein said latch engagement means comprise a rigid member adapted to slide relative to a respective beveled edge and move into a corresponding recess to maintain said bottom panel in supporting relation by said side panels.

7. In a fixture installation assembly adapted to be hung from support means secured to a surface member, said support means being further adapted to support said fixture in hanging relation, the invention comprising:

a pair of side panels, adapted to hang substantially vertically from said support means, each of said side panels having, near the lower end thereof, a side panel attachment member;

a bottom panel of predetermined dimensions having, near each end thereof, a bottom panel attachment member; one of said attachment members comprising latching means, and the other of said attachment members comprising latch engagement means, so that said bottom panel is supportively secured to said side panels; said latching means comprising a projecting member having a leading beveled edge terminating in means defining a recess and said latch engagement means comprising a rigid member adapted to slide relative to a respective beveled edge and move into a corresponding recess to maintain said bottom member in supporting relation by said side panels;

said bottom panel further having an outer edge adapted to intercept said fixture when said fixture is secured in hanging relation from said support means, whereby said bottom member serves to space said fixture a predetermined distance from said surface member.

8. The fixture installation assembly defined in claim 7 wherein said side panel attachment member comprises said latching means, and said bottom panel attachment member comprises said latch engagement means.

* * * * *